US006782840B1

(12) United States Patent
Garelick et al.

(10) Patent No.: US 6,782,840 B1
(45) Date of Patent: Aug. 31, 2004

(54) COMPACTABLE LADDER FOR A BOAT

(75) Inventors: Richard J. Garelick, Minneapolis, MN (US); Ronald M. Berman, Port Orange, FL (US)

(73) Assignee: Garelick Mfg. Co., St. Paul Park, MN (US)

( * ) Notice: Subject to any disclaimer, the term of this patent is extended or adjusted under 35 U.S.C. 154(b) by 0 days.

(21) Appl. No.: 10/367,157

(22) Filed: Feb. 19, 2003

(51) Int. Cl.[7] ..... B63B 17/00
(52) U.S. Cl. ..... 114/362
(58) Field of Search ..... 182/91, 93, 95, 182/97, 100, 127, 82, 89, 90; 114/362

(56) References Cited

U.S. PATENT DOCUMENTS 3,019,851 A * 2/1962 Doss ..... 182/111
4,432,436 A * 2/1984 Suiter ..... 182/97

FOREIGN PATENT DOCUMENTS

EP 416978 A1 * 3/2001

OTHER PUBLICATIONS

Garelick Mfg. Co. Catalog, 2003, p. 6 Items 19833 and 19812 and 19803.

* cited by examiner

*Primary Examiner*—Edwin Swinehart
(74) *Attorney, Agent, or Firm*—Jacobson and Johnson

(57) ABSTRACT

A boat ladder has a rigid I-beam support with steps pivotally attached for making the ladder compact, with the ladder pivotally engaged with a compartment in the boat hull for storing the ladder when not in use.

2 Claims, 5 Drawing Sheets

27
26
22
27
21
10
3
3
12
13
12A
12B
11
12
12A
13
12B
16
15A
14A
15B
14B
12
12A
12B
13
12
12A
13
12B 27
26
27
16
10
12
12A
12
12A
12B
12
12
12A
12B
15B
14B

COMPACTABLE LADDER FOR A BOAT

FIELD OF THE INVENTION

This invention is in the field of ladders for recreational boats. More specifically, it is directed toward a boat ladder with steps foldable into the support member to make the ladder compact for storage into a tubular compartment formed or located in the frame or body or hull of the boat.

DESCRIPTION OF THE PRIOR ART

Conventional boat ladders for recreational boats have parallel outer elongated rigid support members with longitudinally spaced rungs or steps extending between the support members. For use, this type of ladder conventionally has a hook-type of arrangement at one end for latching or coupling to the edge of a boat or dock for getting into and out of the boat. When not in use the ladder is usually stored by laying it on the deck of the boat or alongside a deck rail or perhaps in a small storage closet on the boat.

SUMMARY OF THE INVENTION

The support structure of the instant ladder is an elongated rigid member, preferably made of metal, which in cross section is in the shape of an I beam. Alternatively, the support structure can be described as comprising a pair of back-to-back rigid U channels. The ladder steps, sometimes referred to as rungs, are located in the channels, each step pivotally attached near one end to the side plates of the channels so that the steps can be swung to extend outward from the support for use and swung into the channels for storage. The steps are constructed such that in the extended or use condition the inner ends of the steps butt up against the bottom wall of the channel to hold the steps in place when a person is climbing up or down the ladder. For storage, the steps are swung into the channels to make the ladder compact and the ladder is then placed through a suitable opening into an elongated hollow tubular compartment or chamber which is formed in the frame or body or hull of the boat. A guide block is slidably engaged in the storage compartment and is pivotally engaged at one end with a trunion which is attached to an end of the ladder. For use, the ladder is slid out the opening at one end of the compartment until the guide block reaches a stop at the open end of the compartment and the ladder pivotally swings downward alongside the boat so that the steps can be swung out for entering or leaving the boat. For storage the steps are pivotally swung into the channels, the ladder then is pivotally swung upward and inserted into the compartment through the outside opening. A manually operable latch and a removable cover plate are provided to secure the ladder in place in the compartment and for closing off the access opening to the storage chamber.

DESCRIPTION OF THE PREFERRED EMBODIMENTS

Figure 1:
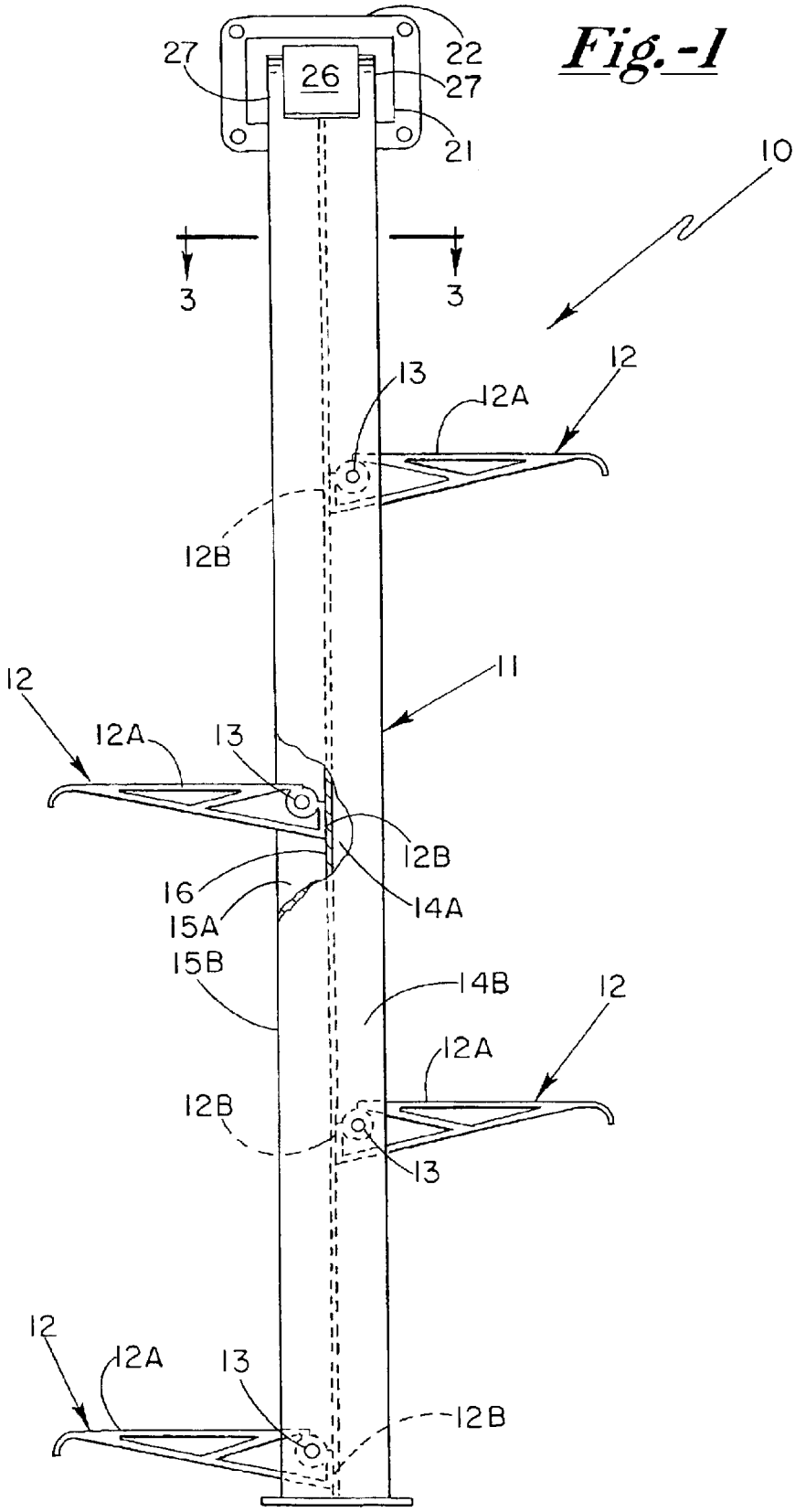
FIG. 1 is a front plan view of an embodiment of the invention showing a ladder in the use position.
Figures 2, 3:
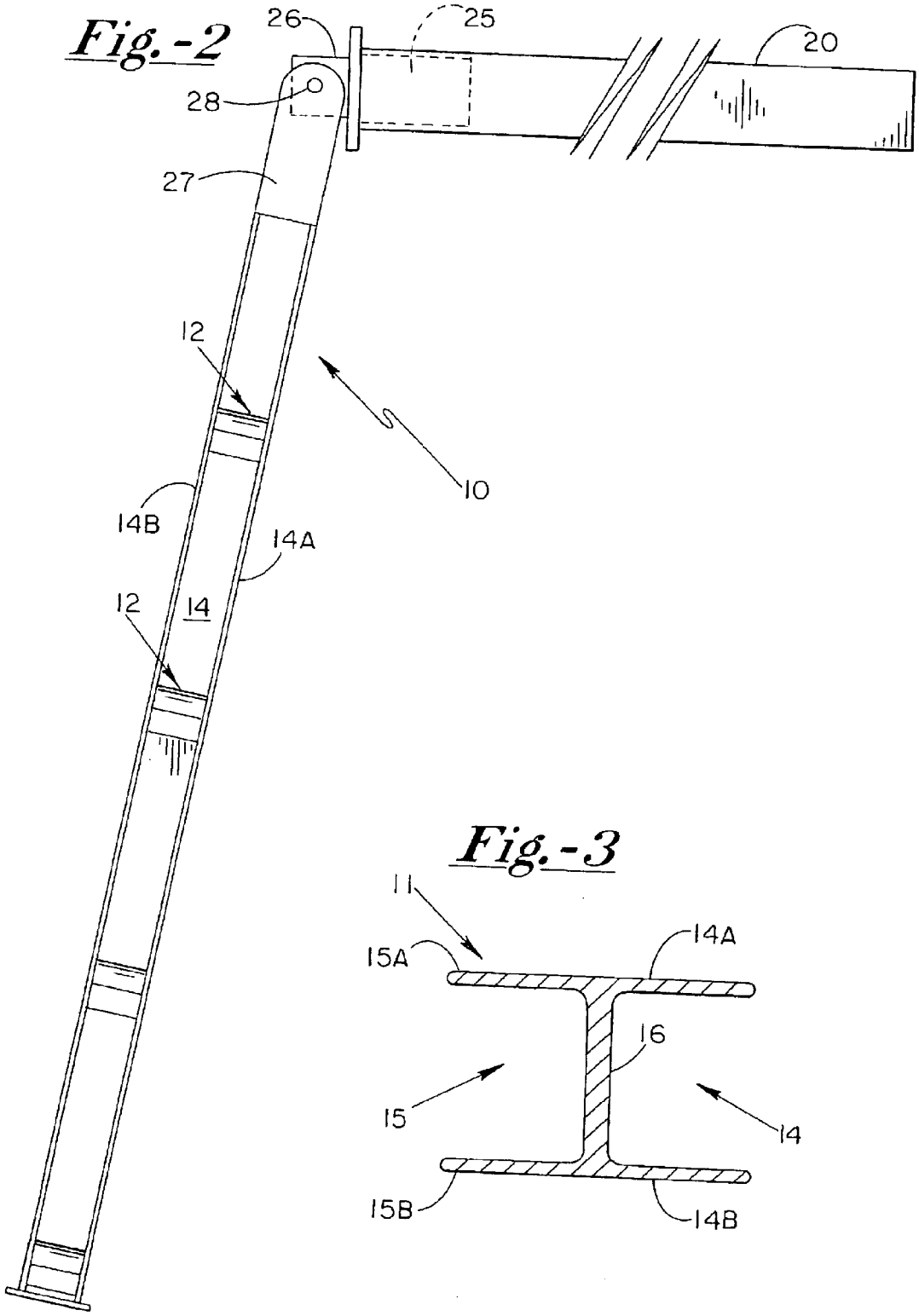
FIG. 2 is a side view of FIG. 1.
FIG. 3 is a section view of FIG. 1.
Figure 4:
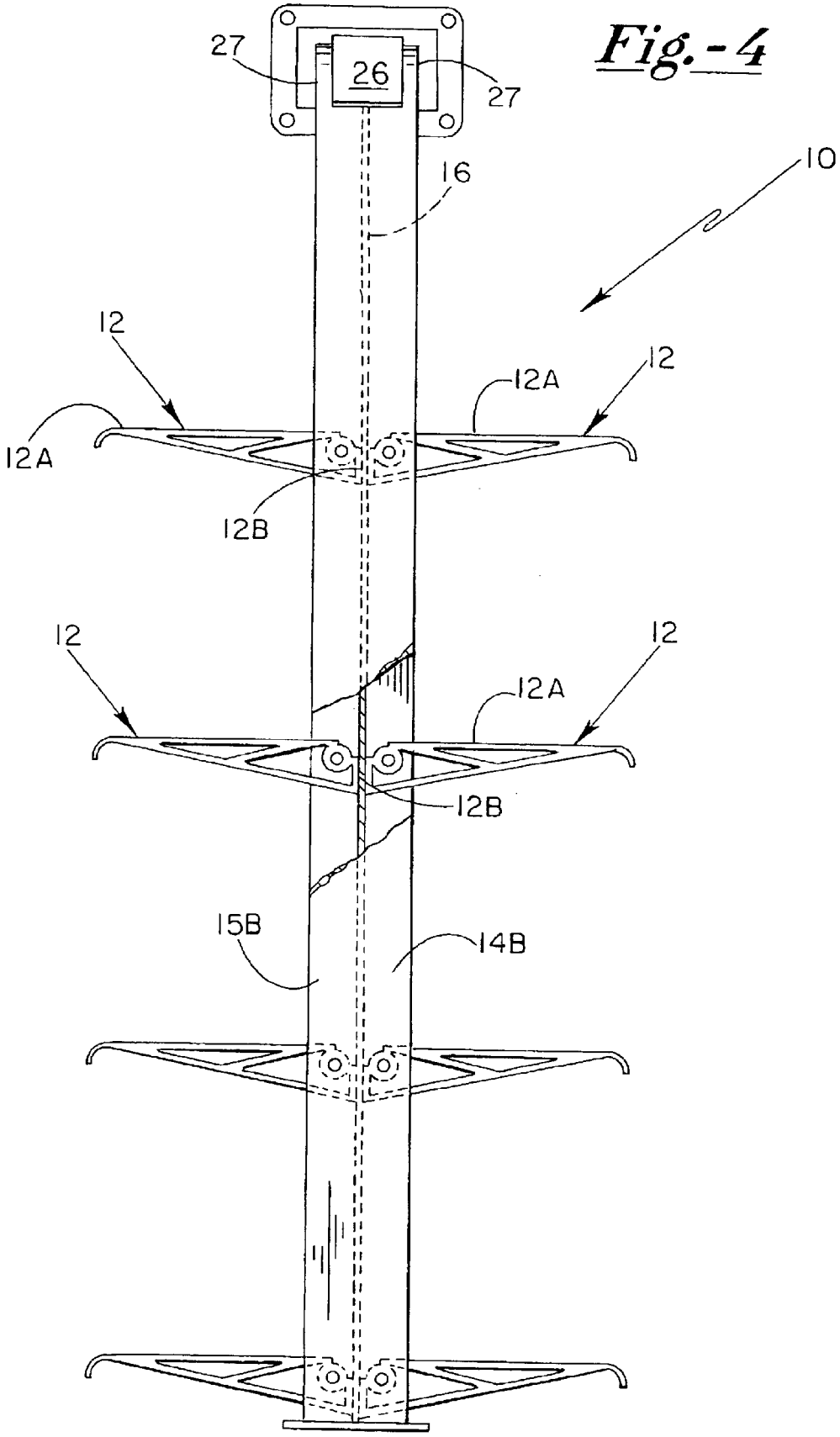
FIG. 4 is a front plan view of another embodiment of the invention.
Figure 5:
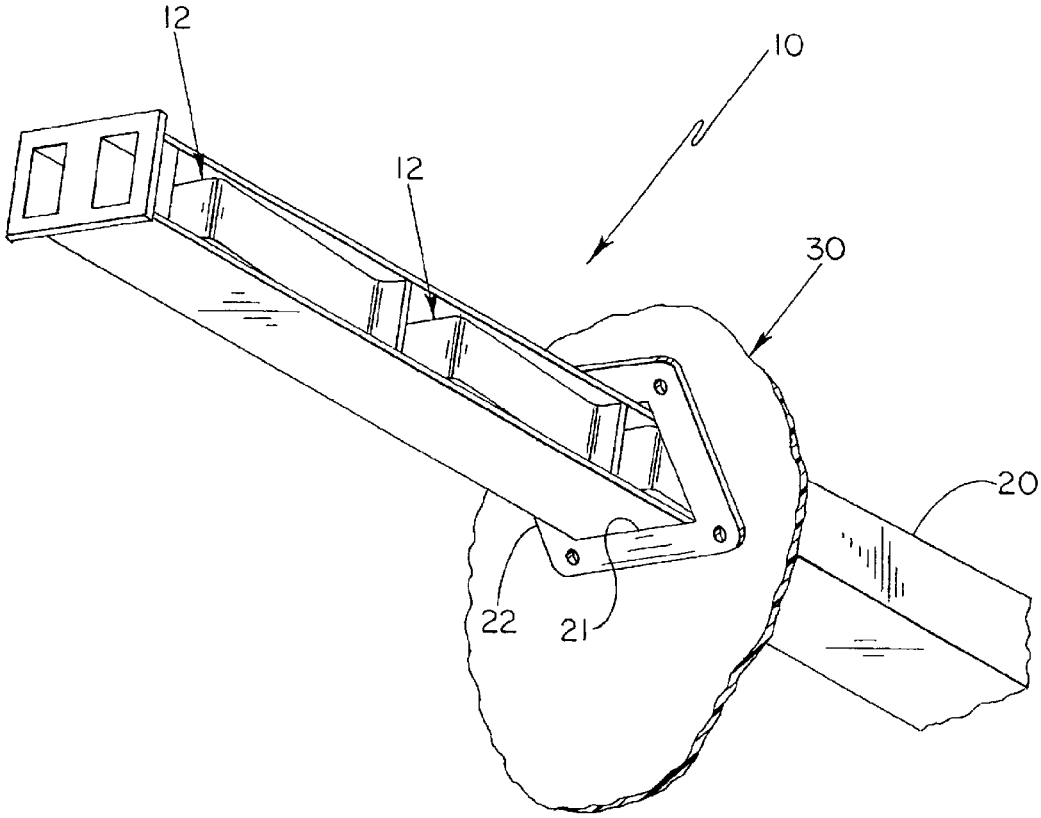
FIG. 5 is an illustration of an embodiment of the invention showing the ladder in the storage condition partially inserted in the storage chamber.

Ladder 10 comprises a main support frame 11 with a set of spaced-apart steps 12 which are pivotally attached to frame 11 at pivot points 13 so that they can be swung inward into support 11 for storage or swung outward, as illustrated in FIG. 1, for use. Support frame 11 preferably is an elongated rigid I-beam, as illustrated in the cross-section view of FIG. 3. Alternatively the support frame 11 can be considered to be a pair of elongate U channels 14 and 15 which are attached back-to-back at a center rigid elongated support 16 and having respective back and front sidewalls or plates 14A, 14B and 15A and 15B with steps or rungs 12 pivotally attached in the respective channels 14 and 15 between front and back side plates 14A and 14B and 15A and 15B. As illustrated most clearly in FIGS. 1 and 4, steps 12 are designed to have a flat planar area 12A so that when steps 12 are swung to extend generally at right angles outward from center support 16 for use as a ladder, area 12A provides support for the user. When steps 12A are swung inward for storage, planar area 12A rests against the center support 16 within U channel 14 or 15. At its inner end each of the steps 12 is formed with a stub or stop 12B which functions to rest firmly against the center support member 16 to hold the step in place when it is in the extended use position. For storage stub or stop 12B swings away from center support 16 into the U channel when the step 12 is swung upward and inward for storage into U channel 14 or 15. As illustrated in FIG. 1, the ladder may constitute a series of longitudinally spaced steps alternately located in channels 14 and 15 to provide alternate left and right steps when in the use condition. FIG. 4 illustrates a variation in which complementary steps appear opposite one another longitudinally spaced to provide correspondingly located steps on both the right and left sides of the ladder in the use condition.

Figure 6:
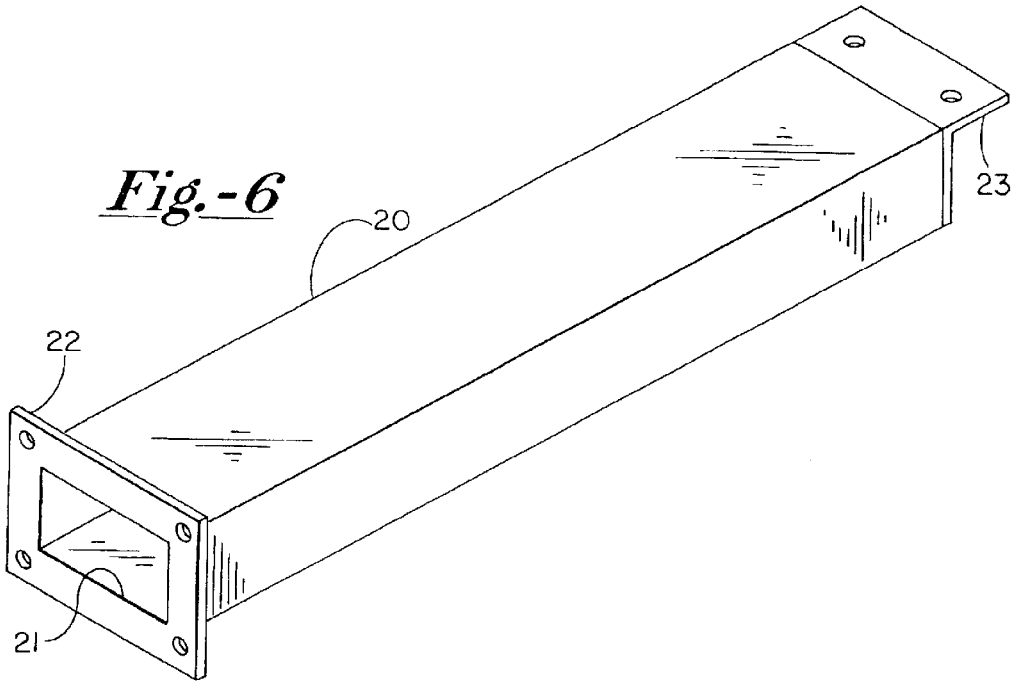
FIG. 6 is a perspective view of a chamber for storing the ladder.
Figure 7:
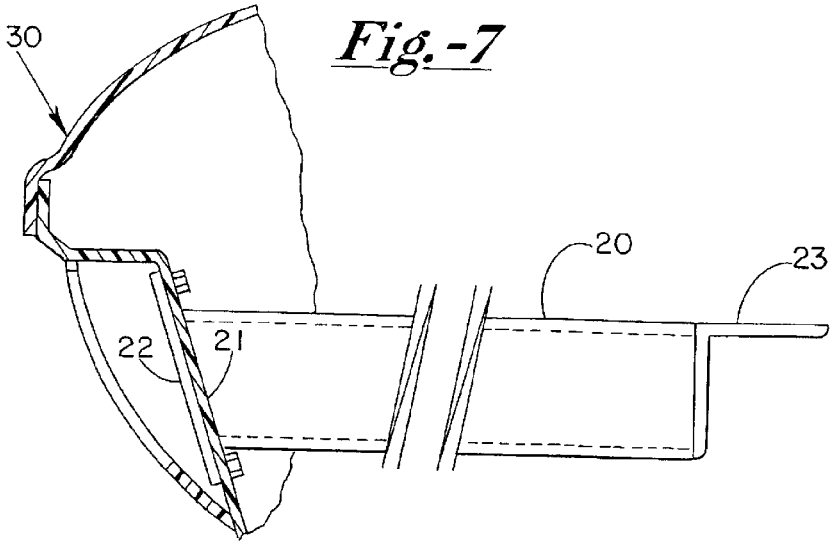
FIG. 7 is an illustration of a ladder storage chamber in the hull of a boat.

Ladder 10 is stored in a storage compartment, such as illustrated in FIG. 6, which is formed or located in the hull of a boat, such as a cruiser or the like, as indicated by reference numeral 30 in FIG. 7. The compartment is an elongated hollow box-like structure 20 having an access opening 21 at one end which for descriptive purposes and in use constitutes the front end of the compartment A flange or frame 22 around opening 21 at the front end and an L bracket 23 at the back end have openings for attachment members, such as screws or bolts or the like, to secure the compartment in place in the interior of the frame or hull of the boat. Slidably engaged in the storage chamber and the interior of compartment 20 is a stop block 25. Stop block 25 is dimensioned so that it will slide freely in the storage chamber of compartment 20 but is prevented from leaving compartment 20 through opening 21 by the inner edges of frame 22. At one end slide block 25 has an undercut extension 26 which is dimensioned to extend out through opening 21 when the stop block 25 is stopped at the open end of the storage chamber. At one end of ladder 10, which is the top end in the use position, ladder 10 has a pair of oppositely disposed spaced-apart curved arms or extensions 27 with a pivot pin or rod 28 extending between the two arms 27. Pivot pin 28 is pivotally engaged in an opening through extension 26 so that ladder 10 is therefore pivotally engaged with slide block 25. For storage the ladder is swung upward about pivot pin 28 while slide block 25 is moved rearward in storage chamber 20 and ladder 10 is inserted into the storage chamber of compartment 20 through opening 21. For use the ladder is pulled out of the storage compartment 20 through opening 21 and swung downward about pivot pin 28 to a generally vertical position when extension 27 extends out from the storage chamber through opening 21. In practice, a suitable cover plate, not shown, is placed over opening 21 when the ladder is in the storage compartment.

As illustrated in FIG. 7, flange or frame 22 and a cover plate may have to be angled or contoured to conform to the shape of the exterior of the hull of the boat.

Also, the ladder may include a latch mechanism at its bottom end for releasably locking it in place when stored in the storage chamber.

As an additional feature, steps 12 on each side of the main support may be connected together by an elongated rod so that all the steps are all swung inward and/or outward in unison.

We claim:

1. A compactable ladder for a boat, comprising:

a) an elongated rigid I-beam support;

b) ladder steps pivotally attached to said support in the I beam channels to swing generally perpendicularly outward from said channels for use and to swing to rest in said channels for storage;

c) said steps spaced from one another lengthwise along said support;

d) means for releasably securing said steps in the use position;

e) an elongated hollow tubular ladder storage compartment in a boat hull, said compartment dimensioned to hold said compactable ladder and having an access opening at the exterior of the boat for receiving said ladder;

f) a stop block slidably located in said compartment;

g) stop means for preventing said stop block from exiting said compartment through said opening;

h) an extension from said stop block for pivotably engaging an end of said boat ladder support such that said ladder support swings downward from said compartment opening for use and is swingable upward for storage into said compartment through said access opening.

2. A compactable boat ladder for storing in a storage compartment of a pleasure boat, comprising in combination:

a) an elongated rigid I-beam support having left and right channels;

b) ladder steps longitudinally spaced along said support, said steps pivotally attached to said support in the I-beam channels to swing generally outward for use and inward to rest in said channels for storage;

c) an elongated hollow tubular storage compartment in the hull of a boat below the boat deck, said compartment dimensioned to hold the ladder in storage with the ladder steps resting in the channels, said compartment having an access opening at the exterior of the boat;

d) a stop block slidably located in said compartment;

e) a stop for preventing said stop block from exiting said compartment through said access opening;

f) an arm extending out of said access opening from said stop block when said stop block is at said stop; and g) a pivot pin attached to said arm for pivotally engaging an end of said ladder support for pivotally swing said ladder downward from said storage compartment for use and upward for insertion into the compartment for storage.

* * * * *